US010037693B2

(12) United States Patent
Ryu et al.

(10) Patent No.: US 10,037,693 B2
(45) Date of Patent: Jul. 31, 2018

(54) DETECTION AREA SETTING METHOD FOR DETECTING PASSING VEHICLES, AND TRAFFIC SIGNAL CONTROL METHOD USING SAME

(71) Applicants: Yeong Geun Ryu, Daegu (KR); Sung Han Jung, Seoul (KR)

(72) Inventors: Yeong Geun Ryu, Daegu (KR); Sung Han Jung, Seoul (KR)

( * ) Notice: Subject to any disclaimer, the term of this patent is extended or adjusted under 35 U.S.C. 154(b) by 0 days.

(21) Appl. No.: 15/543,427

(22) PCT Filed: Nov. 25, 2015

(86) PCT No.: PCT/KR2015/012691
§ 371 (c)(1),
(2) Date: Jul. 13, 2017

(87) PCT Pub. No.: WO2016/114488
PCT Pub. Date: Jul. 21, 2016

(65) Prior Publication Data

US 2018/0005521 A1 Jan. 4, 2018

(30) Foreign Application Priority Data

Jan. 14, 2015 (KR) ..... 10-2015-0007042

(51) Int. Cl.
*G08G 1/08* (2006.01)
*G08G 1/01* (2006.01)
(Continued)

(52) U.S. Cl.
CPC ..... *G08G 1/08* (2013.01); *G08G 1/017* (2013.01); *G08G 1/0145* (2013.01); *G08G 1/052* (2013.01); *G08G 1/065* (2013.01); *G08G 1/095* (2013.01)

(58) Field of Classification Search
None
See application file for complete search history.

(56) References Cited

U.S. PATENT DOCUMENTS 8,520,695 B1 * 8/2013 Rubin ..... G08G 9/02 370/445
9,205,835 B2 * 12/2015 Stein ..... B60W 30/00
(Continued)

FOREIGN PATENT DOCUMENTS

JP 2009-015705 A 1/2009
KR 1997-0005280 A 4/1997
(Continued)

*Primary Examiner* — Fekadeselassie Girma
(74) *Attorney, Agent, or Firm* — Novick, Kim & Lee, PLLC; Jae Youn Kim

(57) ABSTRACT

The present invention relates to a detection area setting method for detecting passing vehicles, and a traffic signal control method using the same and, more particularly, to a detection area setting method for detecting passing vehicles, and a traffic signal control method using the same, the detection area setting method being capable of enabling smooth traffic operation at a crossroad, for example preventing a spillback phenomenon, minimizing green time (green light display time) during which there are no passing vehicles, and extending the green time, if needed, by setting one or a plurality of detection areas at a crossroad so as to detect the traffic volume in respective moving directions of vehicles at a signalized intersection, determining the traffic state in the moving directions of the vehicles according to vehicle information in respective detection areas, and automatically controlling the crossroad signals accordingly.

7 Claims, 11 Drawing Sheets

(51) Int. Cl.

| | |
|---|---|
| ***G08G 1/052*** | (2006.01) |
| ***G08G 1/095*** | (2006.01) |
| ***G08G 1/017*** | (2006.01) |
| ***G08G 1/065*** | (2006.01) |

(56) References Cited

U.S. PATENT DOCUMENTS

| | | | | |
|---|---|---|---|---|
| 9,707,960 | B2 * | 7/2017 | Gutmann | B60W 30/09 |
| 9,857,800 | B2 * | 1/2018 | Ben Shalom | G05D 1/0276 |
| 2010/0004839 | A1 * | 1/2010 | Yokoyama | G08G 1/052 701/70 |
| 2010/0145600 | A1 * | 6/2010 | Son | B60W 50/14 701/123 |
| 2013/0342370 | A1 * | 12/2013 | Sharma | G08G 1/08 340/907 |
| 2015/0210274 | A1 * | 7/2015 | Clarke | B60W 30/00 382/104 |
| 2016/0027299 | A1 * | 1/2016 | Raamot | G08G 1/08 340/917 |
| 2017/0178506 | A1 * | 6/2017 | Witte | G08G 1/096 |
| 2017/0206783 | A1 * | 7/2017 | Miller | G08G 1/08 |
| 2017/0243481 | A1 * | 8/2017 | Neubecker | G08G 1/095 |
| 2017/0243485 | A1 * | 8/2017 | Rubin | G08G 1/096791 |

FOREIGN PATENT DOCUMENTS

| | | | |
|---|---|---|---|
| KR | 10-1998-0067508 | A | 10/1998 |
| KR | 1020020031745 | A | 5/2002 |
| KR | 100446461 | B1 | 8/2004 |
| KR | 1020050020439 | A | 3/2005 |
| KR | 10-2005-0055385 | A | 6/2005 |
| KR | 10-0540608 | B1 | 1/2006 |
| KR | 10-2009-0130535 | A | 12/2009 |
| KR | 10-1211645 | B1 | 12/2012 |
| KR | 10-2014-0101955 | A | 8/2014 |
| KR | 1020140101955 | A | 8/2014 |

* cited by examiner

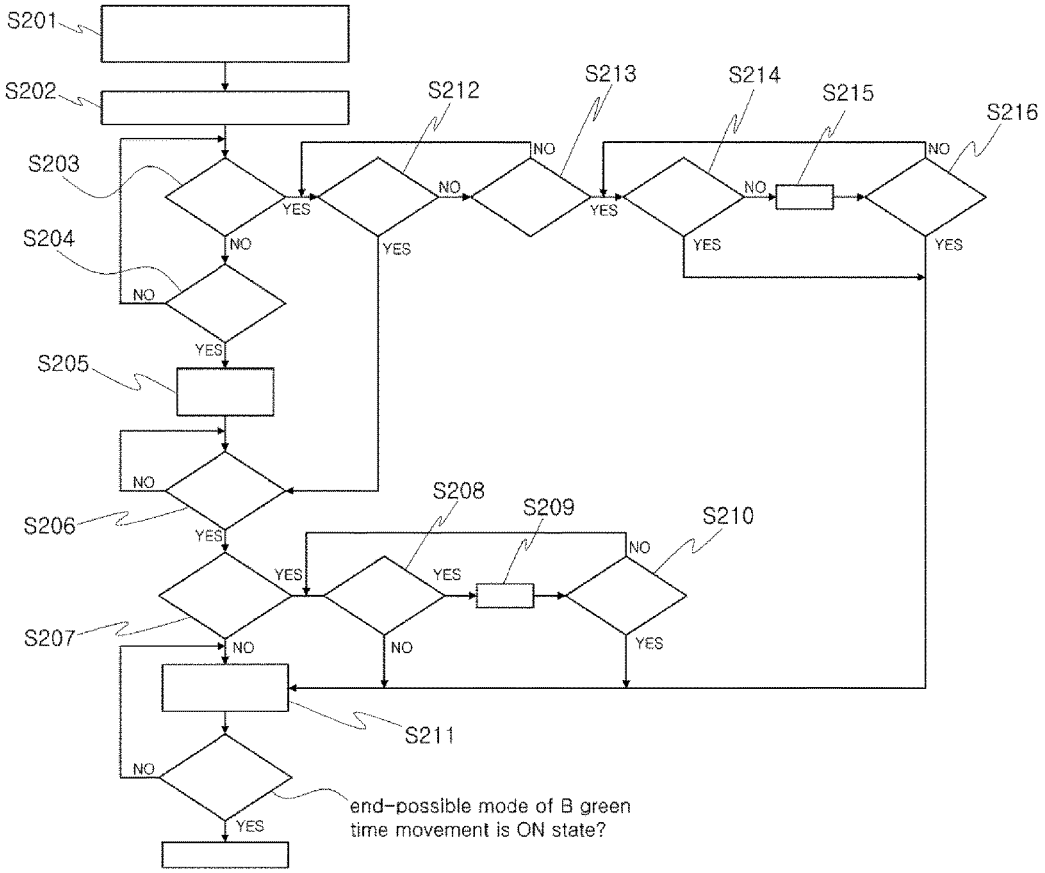

S201 :
green time movement in which the β State is generated -> A green time movement
another green time movement -> B green time movement
S202 : the controller turns on a red signal afer the A green time movement is yellow signal
S203 : RGTC is exceeded?
S204 : A green time movement is γ State?
S205 : the controller turns on a green signal in the A green time movement
S206 : PENT is reached?
S207 : extension application mode of A green time movement is ON state?
S208 : A green time movement maintains the α state?
S209 : UG extension
S210 : ELG is reached ?
S211 : end-possible mode of A green time movement is ON state
S212 : A green time movement is γ State?
S213 : PENT?
S214 : A green time movement is γ State?
S215 : UG extension
S216 : ELR is reached?

FIG. 11

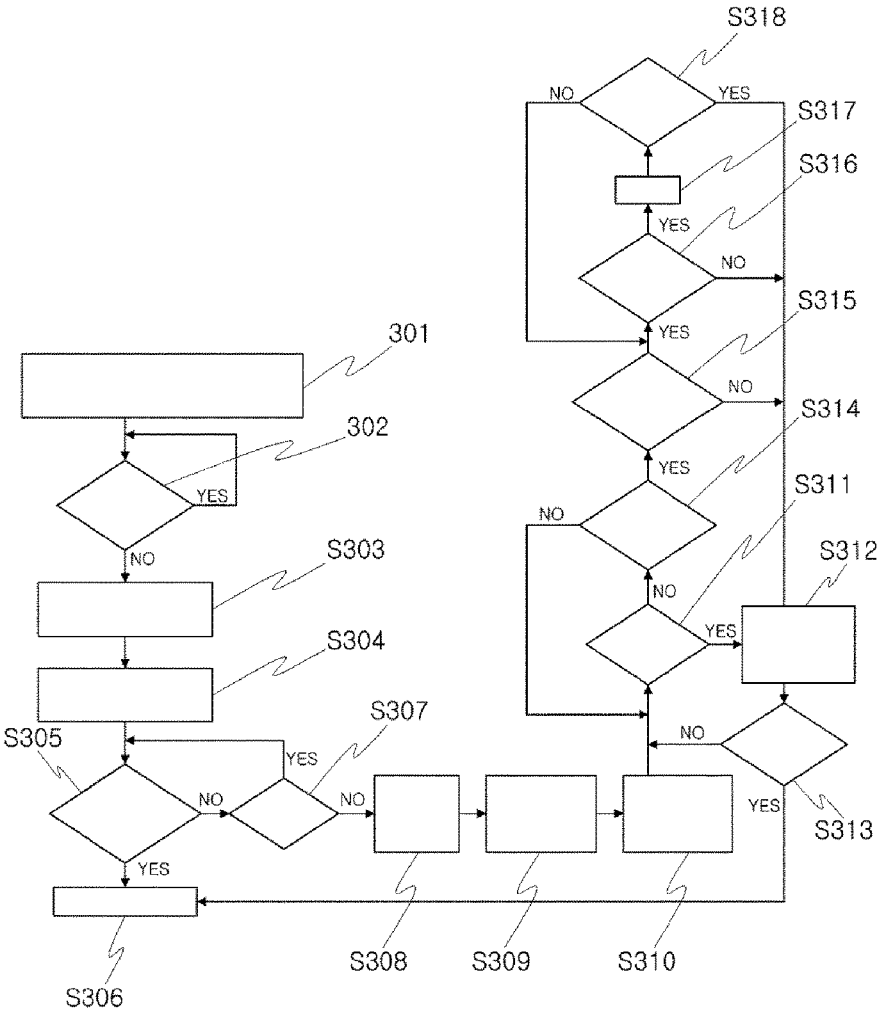

S301 :
green time movement in which the β State is generated -> A green time movement
another green time movement -> B green time movement
S302 : crosswalk is green lighting state?
S303 : the controller turns on a red signal afer the A green time movement is yellow signal
S304 : end-possible mode of A green time movement is ON state
S305 : end-possible mode of B green time movement is ON state?
S306 : Phase End
S307 : RGTC is exceeded?
S308 : alternative movement of A green time movement turns on green signal
S309 : end-possible mode of A green time movement is OFF state
S310 : alternative movement of A green time movement -> turns on A green time movement
S311 : A green time movement maintains the α state?
S312 : end-possible mode of A green time movement is OFF state
S313 : end-possible mode of B green time movement is ON state?
S314 : PENT is reached?
S315 : extension application mode of A green time movement is ON state?
S316 : A green time movement maintains the α state?
S317 : UG extension
S318 : ELG is reached ?

FIG. 12

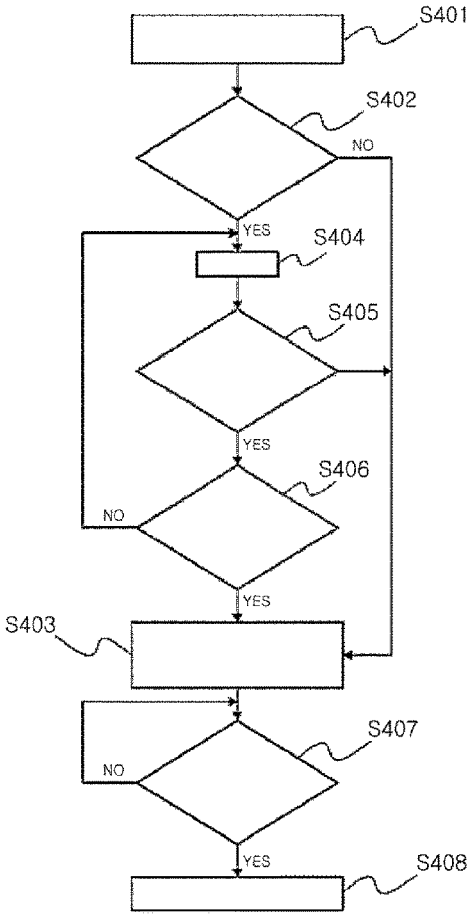

S401 :
green time movement in which the α State is generated
-> A green time movement
another green time movement
-> B green time movement S402 : extension application mode of A green time movement is ON state?

S403 : end-possible mode of A green time movement is ON state?

S404 : UG extension

S405 : A green time movement is γ State?

S406 : ELG is reached?

S407 : end-possible mode of B green time movement is ON state?

S408 : Phase End

FIG. 13

S501 : the controller performs signal control according to a phase sequence recorded on the memory and a phase time S502 : pass information in the entry detection area in all of the direction is γ?

S503 : the controller turns on a red or yellow signal in all of the direction in a flickering manner S504 : α State is generated?

DETECTION AREA SETTING METHOD FOR DETECTING PASSING VEHICLES, AND TRAFFIC SIGNAL CONTROL METHOD USING SAME

TECHNICAL FIELD

The present invention relates to a method of setting a detection area for detecting a passing vehicle and a method of controlling a traffic signal using the same and, more particularly, to a method of setting a detection area for detecting a passing vehicle, which enables an accurate determination of a traffic state for each green time movement within a signal intersection to prevent a spillback phenomenon, to minimize the green time (green lighting time) when there is no passing vehicle, and to extend the green time, if necessary, so that smooth traffic easy-going is performed in the signal intersection by setting one or a plurality of detection areas in the signal intersection so that a passing vehicle for each green time movement of vehicles within the signal intersection is detected, determining a traffic state for each green time movement of vehicles based on vehicle information in each detection area, and controlling an intersection signal for each green time movement, and a method of controlling a traffic signal using the same.

BACKGROUND ART

In general, in order to perform smooth and efficient traffic easy-going in an intersection, a signal waiting time must be minimized. For such smooth and efficient traffic easy-going, to prevent a spillback phenomenon in an intersection which generates a traffic barrier and to minimize the green time when there is no passing vehicle and to extend the green time, if necessary, may be said to be the key.

Accordingly, a signal control method now most used in intersections is a fixed cycle signal control method in which a signal cycle (the time taken for the green lighting of a traffic light for each green time movement to rotate once) and a phase time (the time during which the green light of each traffic light is turned on) are fixed.

However, such a fixed cycle signal control method has a problem in that an accidental change in the volume of traffic attributable to a frequently changing traffic condition, such as a spillback phenomenon suddenly generated due to a traffic accident or a sudden reduction in the volume of traffic, cannot be handled.

In order to solve such a problem, conventionally, a signal control method according to an actual volume of traffic in real time other than signal control using the fixed cycle signal control method is adopted. However, in performing the signal control method according to the volume of traffic, in order to detect the volume of traffic, a detection area using detection means, such as a loop sensor or a camera, is set in a street (a carriageway along which vehicles can pass) ahead of an intersection, but the detection area is set to detect the volume of traffic in each carriageway. In this case, however, there is a problem in that a cost for installation and maintenance and repair is high because the detection area increases in proportion to the number of carriageways. If one carriageway is a shared carriageway also used for going-straight, right-turn and going-straight and left-turn, there is a limit to the improvement of a signal operation or efficient signal control because vehicle pass information cannot be classified and detected for each green time movement.

Furthermore, an already developed intersection spillback phenomenon prevention technology included a method of setting a detection area by disposing detection means in a specific street section of a carriageway, calculating a vehicle speed based on detected information (data), determining a spillback phenomenon based on specific speed criteria, and then changing a green signal to a red signal.

However, the above method is a method of simply changing information about the street occupation time of a vehicle into speed information. Accordingly, there is a good possibility that an error occurs, such as when speed is reduced due to a simple obstacle or stop ahead of an intersection, other than a spillback phenomenon within the intersection because the method is not based on an actual vehicle speed within the intersection.

Furthermore, in the already developed method, in order to prevent a spillback phenomenon, a next phase is performed right after a red signal. Accordingly, there was a problem in that efficiency is very low, such as that the passing of a vehicle in a different green time movement in the state in which an intersection blockage phenomenon is present is performed or one phase switches to a next phase although a spillback phenomenon has been rapidly solved.

Furthermore, conventional intersection signal control methods include a method of sending vehicle detection information collected in a detection area in a street section to a traffic control center in a remote place and determining, by a constructed program or an expert in the traffic control center, a signal operation based on the vehicle detection information. The method had problems in that rapidness (processing time) and efficiency are low because a traffic signal is controlled in a remote place and a cost for operations and maintenance and repair is high.

PRIOR ART DOCUMENT (Patent Document 1) Korean Patent No. 10-0540608
(Patent Document 2) Korean Patent No. 1997-0005280
(Patent Document 3) Korean Patent No. 10-0548776

DISCLOSURE

Technical Problem

The present invention has been made to solve the above problems occurring in the prior art and an object of the present invention is to secure efficiency in setting a detection area because a detection area does not need to be set for each carriageway by setting a detection area within a signal intersection, accurately determining a traffic state according to vehicle pass information for each green time movement within the intersection, and performing intersection signal control.

Furthermore, another object of the present invention is to enable more efficient signal control even in a shared carriageway by setting entry/exit detection areas in signal intersection entry and exit areas in a street section.

Furthermore, another object of the present invention is to enable an accurate determination of a traffic state for each green time movement within an intersection in real time and to facilitate vehicle easy-going within the intersection (to prevent a spillback phenomenon and to minimize a signal waiting time), such as that the passing of a vehicle is limited when a spillback phenomenon is generated or a red signal is turned on in a green time movement in which there is no passing vehicle and instead an alternative movement not hindering the passing of a vehicle within the intersection is made to pass through because real-time signal control is made possible for each green time movement.

Technical Solution

A characteristic of the present invention for achieving the objects is to set a detection area so that vehicle pass information can be detected for each green time movement of vehicles within a signal intersection.

In the above description, the detection area may be set using image detection for reading an image obtained by photographing means by disposing one or a plurality of pieces of photographing means in the periphery of an intersection so that the inside of the intersection can be photographed or loop detection for detecting the volume of traffic based on vehicle information detected by a loop coil sensor by disposing the loop coil sensor in the detection area, and may be set using both the image detection and the loop detection.

Furthermore, a traffic state (smooth, spillback or no vehicle) for each green time movement is determined based on vehicle pass information within a signal intersection which has been detected according to the setting of the detection area, and an intersection signal is automatically controlled for each green time movement based on the determined traffic state. If all of phases can be terminated in respective green time movements, automatic control is performed for each green time movement in such a way as to terminate a corresponding phase and to perform a next phase.

Furthermore, in the present invention, entry/exit detection areas are set in signal intersection entry and exit areas in a street section, and the signal of the signal intersection is automatically controlled based on the volume of traffic in the entry/exit detection areas.

Advantageous Effects

In the present invention, a vehicle that passes through an intersection is determined and detected for each green time movement (going-straight and left-turn, bidirectional going-straight, a bidirectional left-turn, etc.) of a corresponding phase according to the signal phase in detection areas set within a signal intersection. A signal is automatically controlled for each green time movement within the phase not all of phases according to a traffic state for each intersection green time movement, which is checked based on detected vehicle pass information (an occupied time, etc.). Accordingly, there are advantages in that an intersection spillback phenomenon is prevented, a green time when there is no vehicle is minimized, and smooth traffic easy-going is automatically performed, such as that a green signal is extended if necessary.

Furthermore, the present invention has an advantage in that signal control can be performed in another green time movement within the same phase because vehicles passing in going-straight and right-turn shared carriageways or going-straight and left-turn shared carriageways in a detection area set within an intersection can be clearly determined for each green time movement.

Furthermore, in the present invention, each intersection can be optimally operated without association with another intersection. In an applied signal intersection, a detection area has only to be set within the intersection according to a green time movement not a carriageway. Four detection areas have only to be set in a common four-way signal intersection, and two or one detection area has only to be set in a three-way signal intersection and a four-way signal intersection to which narrow streets are connected. Accordingly, there are advantages in that an overall cost is low, a traffic state for each green time movement can be precisely checked, and an intersection signal can be controlled efficiently and automatically.

In particular, in the present invention, if the number of vehicles in each movement that pass through a signal intersection is irregular for each time zone and in an intersection in which signal operation not suitable for the volume of traffic is performed, more effective vehicle easy-going is made possible.

DESCRIPTION OF DRAWINGS

FIG. 11: is a signal control process when a spillback-possible state ($\beta$ state) is generated within an intersection.

FIG. 12: is a signal control process when a no-vehicle movement state ($\gamma$ state) is generated within an intersection.

FIG. 13: is a signal control process when the termination of a normal state ($\alpha$ state) is possible within an intersection.

MODE FOR INVENTION

Figure 1:
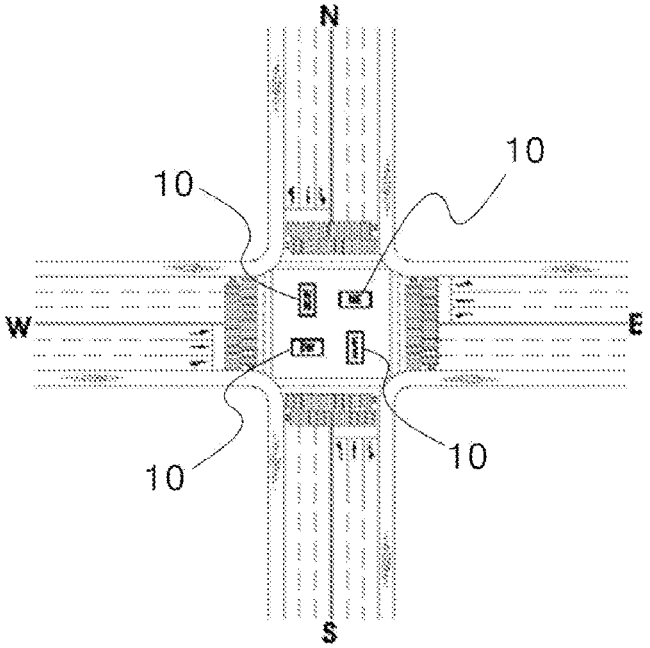
FIG. 1: is an exemplary diagram showing a case where detection areas set within a signal intersection are formed in a quadrangle form in the present invention.

The present invention is for preventing a spillback phenomenon in a signal intersection, reducing a green time when there is no vehicle passing, extending the green time when many vehicles are passing, and automatically performing green lighting in an alternative movement in a green time movement in which there is no passing vehicle, and performs signal control for each green time movement in a phase. To this end, the present invention enables accurate and efficient intersection signal control using a method of setting a detection area so that vehicle pass information for each green time movement within an intersection can be checked, determining a traffic state for each green time movement based on vehicle pass information in each set detection area within the intersection, and controlling an intersection signal for each green time movement in a phase.

In order to perform such a traffic signal control method, the present invention requires a system configured to include detection means (photographing means, a loop sensor, etc.) for obtaining vehicle pass information in a set detection area within an intersection, a traffic light which is disposed in the intersection and whose lighting is controlled in response to an input operation control signal, and a controller which determines a traffic state based on the vehicle pass information of the detection area transmitted by the detection means and controls the lighting of the traffic light disposed in the intersection based on the determined traffic state.

In this case, the controller is configured to include a traffic state determination unit which determines a traffic state, memory which determines a traffic state according to vehicle pass information and on which a variety of types of data and program for controlling a traffic light based on the determined traffic state have been recorded, a lighting control unit for a signal for controlling the lighting of the traffic light, and a control unit which outputs an operation control signal to the lighting control unit using the data of the memory in response to a signal transmitted by the traffic state determination unit.

All of such roles of the controller may be performed by a conventional signal controller, but only the traffic state determination unit may be separated as separate hardware and the roles of the control unit and the lighting control unit may be performed by the signal controller. Both the traffic state determination unit and the control unit may be separated as separate hardware and the role of the lighting control unit may be performed by the conventional signal controller.

The design of such separation of the role and separation of hardware of the controller may be easily changed by those skilled in the art, if necessary. An example in which a single controller performs the entire process of controlling a traffic signal, including the determination of a traffic state and corresponding lighting control, is described below.

Embodiments of the present invention are described in detail below with reference to the accompanying drawings.

First, terms necessary to describe the present invention are defined with reference to the drawings.

FIGS. 1 to 8 are diagrams showing embodiments of a detection area within a signal intersection.

- A detection area 10: the area in which vehicle pass information within an intersection is detected using image detection or loop detection or both the image detection and the loop detection through the detection means. The loop detection refers to an area detected by a loop coil sensor disposed in a specific range in which vehicle pass information for each green time movement within an intersection can be obtained. The image detection refers to an area of a specific range in which vehicle pass information for each green time movement within an intersection is obtained through signal processing for an image obtained by photographing means (camera) disposed within the intersection or in the periphery of the intersection. In order to further improve accuracy, both the loop detection and the image detection may be used. In this case, two detection areas may be matched up to be identical with each other or may be synchronized.

The detection area set as described above may be formed in the shape or size of a quadrangle, a circle or an oval or may be formed in a polygon, such as a hexagon or an octagon, as shown in FIGS. 1 to 8. In the case of a loop coil sensor that forms the detection area, occupied time information of a vehicle that proceeds in a green signal time has only to be obtained regardless of the number of revolutions of the coil. Accordingly, one or a plurality of the loop coil sensors may be disposed within an intersection.

Figure 9:
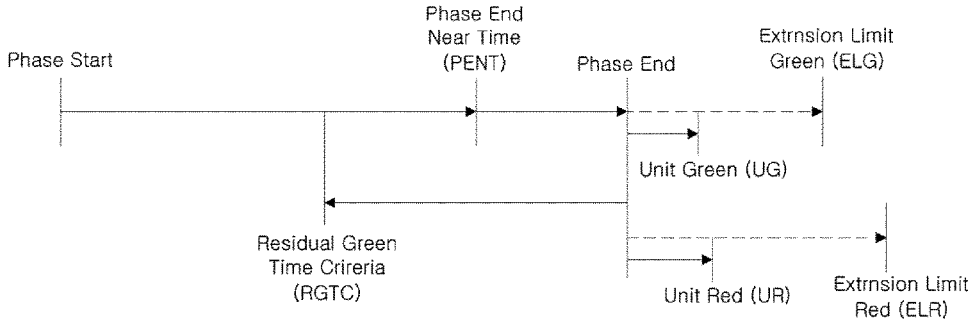
FIG. 9: is an explanatory diagram showing the concept of terms related to phase times in the present invention.

FIG. 9 shows terms used in the present invention in one phase progress in terms of a temporal concept.

- A phase: it is an element that forms a signal cycle, and means a green time movement that assigns a pass right (green signal). A phase time means a green time in a green time movement.
- A phase end near time (PENT): it is the time close to the end of a phase green time and is a point of time at which signal extension or signal stop in a green time movement within a corresponding phase is determined.
- Unit green (UG): it is the extension unit of a green time, and means the time during which vehicles of a specific number can pass through an intersection. The UG may be determined and applied by monitoring the intersection pass time interval of one vehicle.
- Extension limit green (ELG): it is the time during which a green time can be extended to a maximum extent beyond a phase end time in a normal mode. The time determined by monitoring traffic characteristics, etc. may be applied to the ELG.
- Unit red (UR): it is the time during which a red signal is extended in a specific unit in order to solve a spillback-possible state (β state, described below) if the spillback-possible state has not been solved in a corresponding phase.
- Extension limit red (ELR): it is a maximum time during which a red signal can be extended in order to solve the spillback-possible state (β state, described below) until the spillback-possible state continues during red lighting in a green time movement until the phase end near time (PENT) is reached.
- Residual green time criteria (RGTC): it is a time value at which signal control is determined based on the remaining phase time after a signal is changed to a red signal due to the spillback-possible state (β state) or a no-vehicle movement state (γ state, described below) occurring in a green time movement. The RGTC may be uniformly determined and applied, or a time value determined by monitoring the geometric structure characteristic, traffic characteristic, etc. of a corresponding intersection may be applied as the RGTC.

Although not proposed in FIGS. 1 to 9, terms used for the embodiments of the present invention are described below.

- A normal mode: it refers to a signal driving mode that does not require the adjustment of a signal lighting time according to a traffic state. This also includes intersection lighting control according to a conventional fixed signal control method in which a signal lighting time for each time zone has been adjusted.
- A control mode: it is a signal driving mode according to the present invention in which a signal lighting time is adjusted according to a traffic state.
- An end-possible mode: it is a mode in which a phase can be terminated. A phase cannot be terminated when the end-possible mode is set as "OFF" and can be terminated only when the end-possible mode is set as "ON."

A green time movement (GM): it is a progress traffic line for each direction in which a vehicle can proceed, such as going-straight or left-turn in which a green signal is turned on in a phase, and excludes right-turn. Examples of the green time movement (GM) has two green time movements (going-straight and left-turn, bidirectional going-straight, bidirectional left-turn, etc.) in one signal phase in a common four-way signal intersection. Furthermore, the green time movement (GM) has two green time movements (bidirectional going-straight) in one signal phase or one green time movement (left-turn) in one signal phase in a three-way intersection.

An occupied time (OT): it is the time taken in a detection area when one vehicle passes through the detection area in a green time.

Occupied time criteria (OTC): they are the time determined to have a good possibility that a spillback phenomenon may occur because a vehicle occupied time continues. In the present invention, when a vehicle occupied time (OT) exceeds the criteria, it is determined to be the spillback-possible state (β state, described below), and signal control is performed. The occupied time criteria (OTC) may be uniformly determined and applied, or the time determined by monitoring the geometric structure characteristic, traffic characteristic, etc. of a corresponding intersection may be applied as the occupied time criteria (OTC).

A gap time (GT): it means a time interval between vehicles that pass through a detection area in a green time, and it is a non-occupied time.

Gap time criteria (GTC): they are time criteria that require signal control because a gap time when there is no passing vehicle in a green time movement permitted in a green time continues. In the present invention, when the criteria is reached, it is determined to be the no-vehicle movement state (γ state, described below) and signal control is performed. The gap time criteria (GTC) may be uniformly determined and applied, or the time determined by monitoring the geometric structure characteristic, traffic characteristic, etc. of a corresponding intersection may be applied as the gap time criteria (GTC).

A normal state (α state): it is the state in which a vehicle normally passes in a green time. The normal state is a pass state in which the occupied time (OT) is shorter than the occupied time criteria (OTC) and the gap time (GT) is shorter than the gap time criteria (GTC) (the occupied time (OT)<the occupied time criteria (OTC) and the gap time (GT)<the gap time criteria (GTC)).

The spillback-possible state (β state): it is a vehicle pass state in which an intersection spillback phenomenon may occur in the green time movement of a green time. It is a pass state in which the occupied time (OT) is equal to or longer than the occupied time criteria (OTC) (the occupied time (OT)≥the occupied time criteria (OTC)).

The no-vehicle movement state (γ state): it is a pass state in which an unnecessary green time not having a passing vehicle is generated in the green time movement of a green time. It is a pass state in which the gap time (GT) not having a passing vehicle is equal to or longer than the gap time criteria (GTC) (the gap time (GT)≥the gap time criteria (GTC)).

An alternative movement (AM): it is a green time movement in which a green time movement is stopped in the no-vehicle movement state (γ state) in the green time movement and a movement is possible by generating a green signal without hindering a pass in a different green time movement in the same phase.

A green time extension mode: it is a control mode set if a green time is to be extended even after a phase green light time end time. The green time extension mode may be applied from the phase end near time (PENT) before a phase is terminated for each green time movement. In order to apply such a green time extension mode, an extension application mode for each phase may be set in advance. When the extension application mode is set, the traffic state determination unit extends and performs the determination of a traffic state based on vehicle pass information transmitted by the detection means in a corresponding detection area. In response thereto, the controller controls the lighting of a signal.

The embodiments of the present invention are described below based on the defined terms.

First, in setting a detection area, criteria for setting the detection area are as follows. Basically, in one detection area, only one green time movement within one phase is detected. The detection area is set so that all of vehicles that enter an intersection other than right-turn in one street connected to the intersection are detected.

Figure 2:
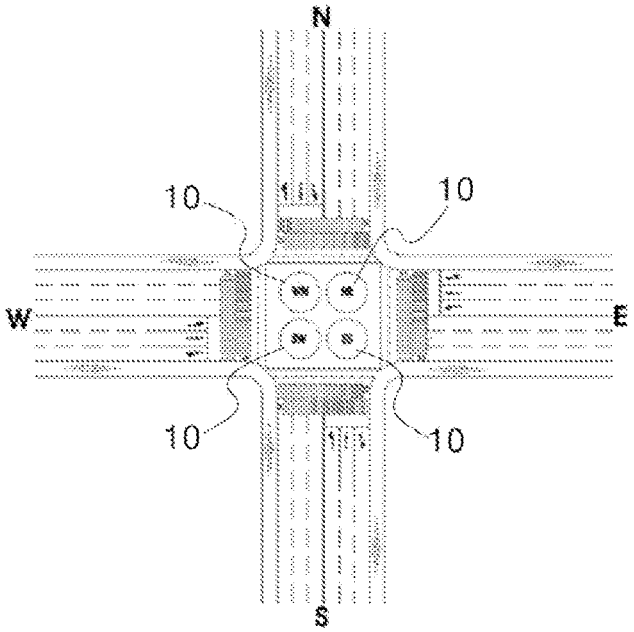
FIG. 2: is an exemplary diagram showing a case where detection areas set within a signal intersection are formed in a circular form in the present invention.

For example, in a common four-way signal intersection, four detection areas for detecting vehicles passing within the intersection are set as shown in FIGS. 1 and 2. In the four-way signal intersection, one phase has two green time movements, and the two green time movements are detected in different detection areas.

Furthermore, in the intersection connection part of a target street, if going-straight is three carriageways and a detection area has a quadrangle shape, the length in the long side of the detection area must be a length in which all of going-straight vehicles in the three carriageways can be detected. The short side of the detection area is set to be an average stop interval or more between vehicles that wait for a signal in a street section. If the detection area has a circle, it is set so that all of going-straight vehicles passing in the diameter of the circle can be detected.

Furthermore, the detection area needs to be set so that a right-turn vehicle is not detected. The detection area is set so that the closest left-turn vehicle traffic line can be detected and is set at the location from which a vehicle can exit from an intersection most rapidly after the vehicle is detected in the detection area.

Examples in which detection areas are set based on the criteria are shown in FIGS. 1 and 2 in which detection areas have been set in a four-way signal intersection. FIG. 1 shows an example in which detection areas of a quadrangle have been set, and FIG. 2 shows an example in which detection areas of a circle have been set.

In the figures, an NE detection area within the intersection has been set based on a going-straight carriageway in an S direction intersection connection street. An ES detection area has been set based on a W direction, an SW detection area has been set based on an N direction, and a WN detection area has been set based on a going-straight carriageway in an E direction. The detection areas have been set so that a right-turn vehicle is not detected. The detection areas have been set so that not only a going-straight vehicle, but a close left-turn vehicle is detected. In the case of the NE detection area, a going-straight vehicle from the S direction to the N direction is detected. Furthermore, a left-turn vehicle from the N direction to the E direction is detected. Likewise, in the ES detection area, a going-straight vehicle from the W direction to the E direction and a left-turn vehicle from the E direction to the S direction are detected. In the SW detection area, a going-straight vehicle from the N direction to the S direction and a left-turn vehicle from the S direction to the W direction are detected. In the WN detection area, a going-straight vehicle from the E direction to the W direction is detected, and a left-turn vehicle from the W direction to the N direction is detected.

In the four detection areas set in the four-way signal intersection, only the detection data of two detection areas in a diagonal line direction is always used as detection data according to a signal phase.

In the four-way signal intersection shown in FIG. 1, to express the detection areas according to a signal phase in the case of a separation signal that is the most common signal operation method is shown in Table 1. A simultaneous signal is shown in Table 2.

TABLE 1

| 1 phase (1) | | 2 phase (2) | | 3 phase (3) | | 4 phase (4) | |
|---|---|---|---|---|---|---|---|
| moving direction | detection area | moving direction | detection area | moving direction | detection area | moving direction | detection area |
| going-straight S→N | NE | Turn left N→E | NE | going-straight W→E | ES | Turn left E→S | ES |
| going-straight N→S | SW | Turn left S→W | SW | going-straight E→W | WN | Turn left W→N | WN |

TABLE 2

| 1 phase (1) | | 2 phase (2) | | 3 phase (3) | | 4 phase (4) | |
|---|---|---|---|---|---|---|---|
| moving direction | detection area | moving direction | detection area | moving direction | detection area | moving direction | detection area |
| going-straight S→N | NE | Turn left E→W | WN | going-straight N→S | SW | Turn left W→E | ES |
| going-straight S→W | SW | Turn left E→S | ES | going-straight N→E | NE | Turn left W→N | WN |

Table 1 is an exemplary table of detection areas applied for each phase in the separation signal. Table 2 is an exemplary table of detection areas applied for each phase in the simultaneous signal. In Table 1 and Table 2, the direction or phase sequence is only one example for describing a phase method and may be different in an actual signal intersection.

In the separation signal of Table 1, the 1 phase is a going-straight signal between the south (S) and the north (N). A vehicle that moves from the south to the north is detected in the NE detection area. In the opposite direction, the occupied time of a vehicle that moves in the SW detection area in the diagonal direction of the NE detection area is detected.

In the next phase (2 phase), in the NE detection area in which the going-straight vehicle from the south to the north was detected in the 1 phase, a vehicle that turns left from the north (N) to the east (E) is detected. In the SW detection area of a diagonal line, a vehicle that turns left from the south (S) to the west (W) is detected.

In the 3 phase, in the WN detection area and the ES detection area not used in the 1 and the 2 phases and mutually located in the diagonal line, vehicles that go straight between the east (E) and the west (W) are detected. In the WN detection area, a going-straight vehicle that moves from the east (E) to the west (W) is detected. In the ES detection area, a going-straight vehicle that moves from the west (W) to the east (E) is detected.

In the WN detection area of the 4 phase, a vehicle that turns left from the west (W) to the north (N) is detected. In the ES detection area (ES), a vehicle that turns left from the east (E) to the south (S) is detected.

Even in the simultaneous signal of Table 2, as in the separation signal of Table 1, in one phase, two green time movements are detected in two detection areas located in a diagonal direction.

In the 1 phase, a vehicle that goes straight from the south (S) to the north (N) is detected in the NE detection area. A vehicle that turns left from the south (S) to the west (W) is detected in the SW detection area located in the diagonal line of the NE detection area.

In the 2 phase, detection is performed using the WN detection area and the ES detection area of a diagonal direction and not used in the 1 phase. In the WN detection area, a vehicle that goes straight from the east (E) to the west (W) is detected. In the ES detection area, a vehicle that turns left from the east (E) to the south (S) is detected.

In the 3 phase, a vehicle that goes straight from the north (N) to the south (S) and a vehicle that turns left from the north (N) to the east (E) are detected. A vehicle that turns left is detected in the NE detection area, and a vehicle that goes straight is detected in the SW detection area.

In the 4 phase, a green is turned on from the west (W) to the east (E) and from the west (W) to the north (N). A vehicle that goes straight is detected in the ES detection area (ES), and a vehicle that turns left is detected in the WN detection area.

In a detection area in a three-way signal intersection or a four-way signal intersection having narrows streets connected, criteria for setting a common four-way signal intersection (only a going-straight vehicle and left-turn vehicle are detected other than a right-turn vehicle) basically need to be satisfied. Two or one detection area is set depending on a condition, such as the inside of an intersection having a narrow width. If one detection area is large, a plurality of detection areas may be set, and the results of detection may be construed as being one result.

Figure 3:
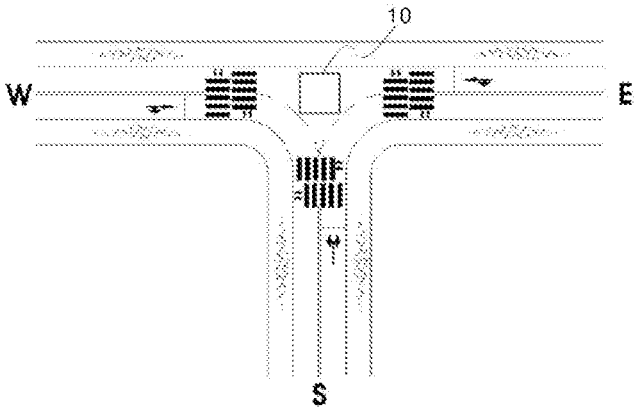
FIG. 3: is an exemplary diagram showing a case where a detection area set within a three-way signal intersection is formed in a quadrangle form in the present invention.
Figure 4:
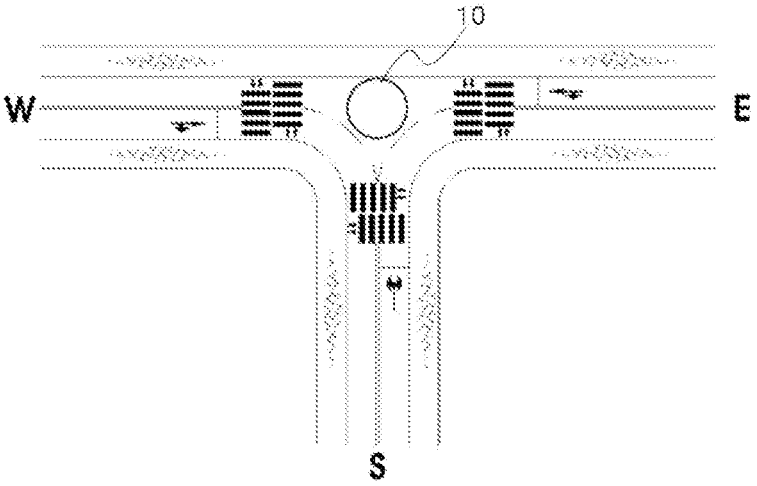
FIG. 4: is an exemplary diagram showing a case where a detection area set within a three-way signal intersection is formed in a circular form in the present invention.
Figure 5:
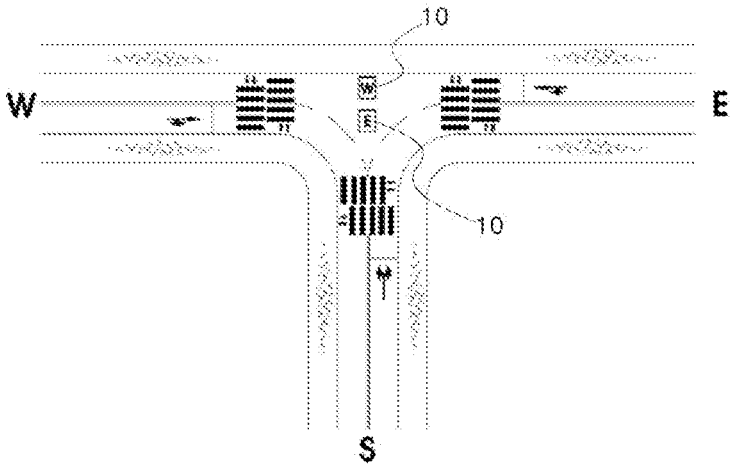
FIG. 5: is an exemplary diagram showing a case where two detection areas set within a three-way signal intersection are formed in a quadrangle form in the present invention.
Figure 6:
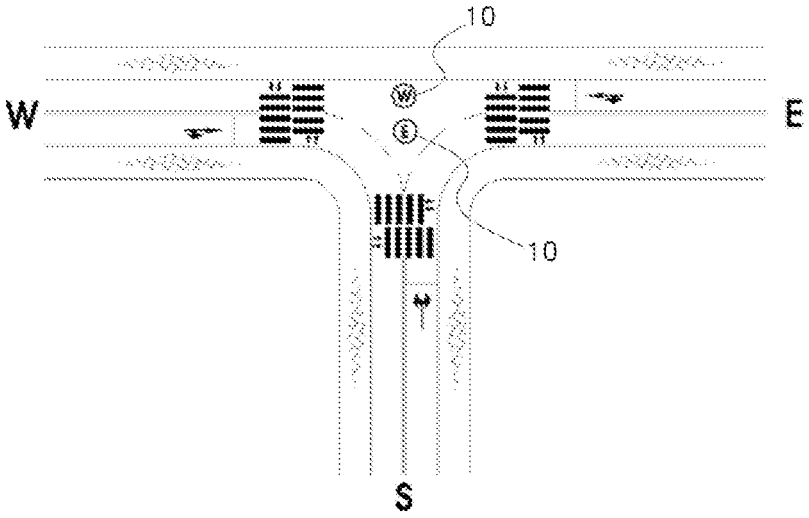
FIG. 6: is an exemplary diagram showing a case where two detection areas set within a three-way signal intersection are formed in a circular form in the present invention.
Figure 7:
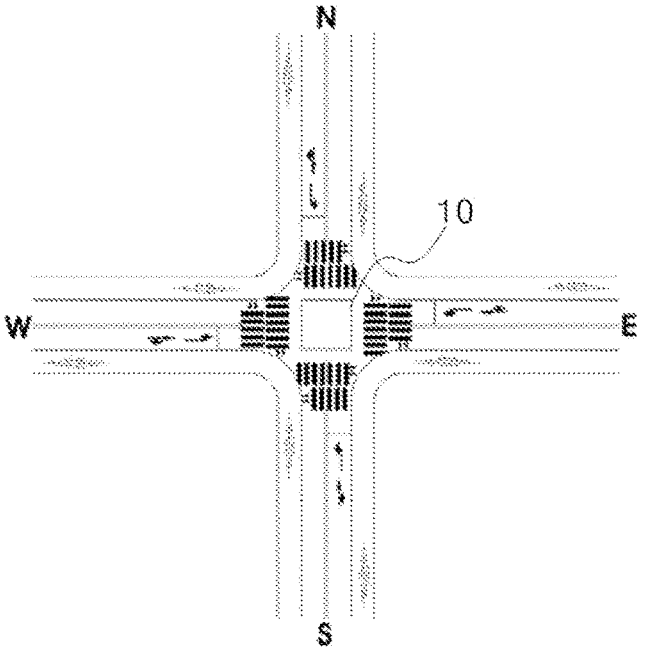
FIG. 7: is an exemplary diagram showing a case where a detection area set within a four-way signal intersection having a narrow breadth is formed in a quadrangle form in the present invention.
Figure 8:
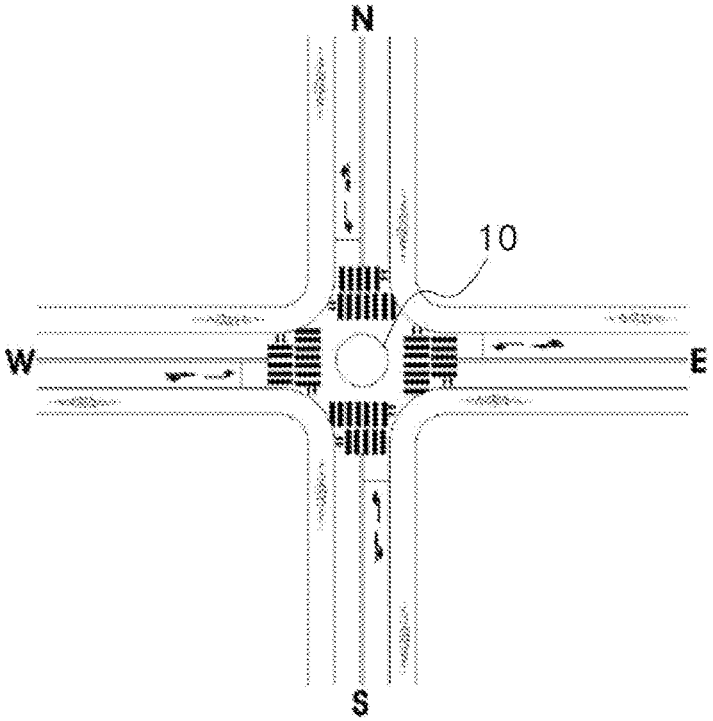
FIG. 8: is an exemplary diagram showing a case where a detection area set within a four-way signal intersection having a narrow breadth is formed in a circular form in the present invention.

FIG. 3 shows an example in which a detection area of a quadrangle shape has been set in a three-way signal intersection. FIG. 4 shows an example in which a detection area of a circle shape has been set in a three-way signal intersection. FIG. 5 shows an example in which two detection areas of a quadrangle shape have been set in a three-way signal intersection. FIG. 6 shows an example in which two detection areas of a circle shape have been set in a three-way signal intersection. FIG. 7 shows a detection area of a quadrangle shape in a four-way signal intersection to which streets having a narrow width have been connected. FIG. 8 shows a detection area of a circle shape in a four-way signal intersection to which streets having a narrow width have been connected.

Table 3 is an example showing the detection of each green time movement by disposing two detection areas in a three-way signal intersection.

TABLE 3

| 1 phase (φ1) | | 2 phase (φ2) | | 3 phase (φ3) | |
|---|---|---|---|---|---|
| moving direction | detection area | moving direction | detection area | moving direction | detection area |
| going-straight E→W | W | turn left S→W | E | turn left E→S | E |
| going-straight W→E | E | | | | |

In the present invention, the transmission (sending) of vehicle detection information detected in a detection area, the transmission of results, interpreted by a traffic state analysis method based on a detected vehicle detection occupied time, to the intersection signal controller, and signal synchronization driving according to a signal control method of the present invention in the intersection signal controller comply with the existing method or are based on the existing method.

In the present invention, after a detection area within an intersection is set as described above, the controller first determines a phase green time movement of a vehicle, determines the vehicle pass information of the set detection area based on the phase green time movement, and analyses a traffic state.

In this case, a process of determining the phase green time movement may be omitted. The reason for this is that when a previous phase is terminated in the normal state, a vehicle within an intersection moves only in a predetermined direction along the phase within a range not having an illegal pass, and thus there is no problem in signal control although only the direction in which a vehicle passes is determined regardless of a phase green time movement. If an illegal pass vehicle generated at a point of time at which an orange or red light is changed is taken into consideration, an error range (e.g., when the number of traffic vehicles within a specific time after the start of a phase is a specific number or less) may be set and excluded from signal control when information of the corresponding error range is generated. In order to fundamentally prevent the generation of a signal control error attributable to an illegal pass or the like, a traffic state may be determined with respect to a green time movement previously set in a corresponding phase and signal control may be performed.

Meanwhile, detection information that belongs to vehicle pass information transmitted from a detection area and that is required in a process of determining a traffic state is the vehicle occupied time (OT) and the gap time (GT).

That is, in the case of a traffic state in which the vehicle occupied time (OT) is shorter than the occupied time criteria (OTC) and the gap time (GT) is shorter than the gap time criteria (GTC), it is determined to be the normal state (α state). When the vehicle occupied time (OT) is detected to be the occupied time criteria (OTC) or more set in a corresponding signal intersection, it is determined that delay (the spillback-possible state, the β state) has occurred in the signal intersection. When the gap time (GT) is longer than the gap time criteria (GTC) because there is no vehicle passing in a green signal, it is determined to be the state (γ state) in which there is no vehicle in a green time movement and that an unnecessary green time is in progress. Such a determination of the traffic state is performed in real time.

The controller controls an intersection signal based on the determination of the traffic state. If the traffic state of all of green time movements from detection information is the normal state (α state), the controller performs signal control in the normal mode. If the traffic state of a specific green time movement is the state (β state) having a good possibility of a spillback phenomenon or the state (γ state) in which there is no vehicle in a green time movement, the controller enters the control mode and performs signal control. If termination is possible in the normal state (α state) without the β state and the γ state, the controller checks the green signal extension mode and continues to proceed or terminates a phase and proceeds to a next phase.

In such signal control, all of a plurality of green time movements are not controlled identically, but are controlled for each green time movement in a movement phase (In general, two green time movements in one phase in the case of a four-way signal intersection operating in four phases, and two or one green time movement in one phase in the case of a three-way intersection operating in three phases).

Furthermore, a signal control process for the signal control includes the entire signal control process, and it is divided into a signal control process when one green time movement traffic state within a phase is the β state, a signal control process when one green time movement traffic state within a phase is the γ state, and a signal control process when a green time movement traffic state within a phase can be terminated in the α state.

In the above description, in the entire signal control, when a phase starts, the entire end-possible mode in a corresponding phase green time movement becomes OFF. When the spillback-possible state (β state) is generated for each green time movement, a process of controlling a signal in the spillback-possible state (β state) is executed. When the no-vehicle movement state (γ state) is generated, a process of controlling a signal in the no-vehicle movement state (γ state) is executed. When the phase end near time (PENT) is reached without the generation of the β state or the γ state, a process of controlling a signal in the normal state (α state) termination possible is executed. When the process is terminated, a next phase proceeds.

Furthermore, in the signal control process in the β state, the traffic light of a green time movement in the corresponding β state is turned on in a red signal after a yellow signal if a traffic state in any one green time movement is the spillback-possible state (β state).

In this state, when the green time movement in the corresponding β state becomes the no-vehicle movement state (γ state) without the lapse of the residual green time criteria (RGTC), the signal is turned in green again. After the phase end near time (PENT) elapses, when the extension application mode in the corresponding green time movement is ON, the green signal is repeatedly extended up to the extension limit green (ELG) by the unit green (UG). If a traffic state prior to the extension limit green (ELG) is not the normal state (α state), the entire end-possible mode becomes ON.

After a red signal is turned on, if a movement point of time passes through the residual green time criteria (RGTC) and continues to be the no-vehicle movement state (γ state) in the phase end near time (PENT), the red signal may be extended up to the extension limit red (ELR) by the unit red (UR).

In this process, when the no-vehicle movement state (γ state) is reached prior to the phase end near time (PENT), whether the extension mode is ON is checked in the phase end near time (PENT). If the extension mode is ON, the unit green (UG) is repeatedly extended within the extension limit green (ELG).

Furthermore, when the extension limit red (ELR) is reached or the no-vehicle movement state (γ state) is reached after the phase end near time (PENT), the end-possible mode of a green time movement becomes ON. When the end-possible mode of the green time movement in a different green time movement in the same phase is ON, a green time movement phase is stopped.

For another example, in the above description, in the signal control process in the γ state, when a traffic state in any one green time movement is the no-vehicle movement state (γ state), a crosswalk traffic light in a green time movement of the corresponding γ state is determined. When the crosswalk traffic light is not turned on in green, the traffic light of the green time movement in the corresponding γ state is turned on in a yellow signal and then turned on in a red signal and the end-possible mode becomes ON. When the end-possible mode of a different green time movement is ON, a corresponding phase is terminated.

Furthermore, when the end-possible mode of the different green time movement is not ON and is ahead of the residual green time criteria (RGTC), an alternative movement in a green time movement in the γ state is turned on in green, and the end-possible mode of the green time movement becomes OFF.

Furthermore, the traffic state of an alternative movement is determined. When the traffic state of the alternative movement is not the γ state and the traffic state is the normal state (α state) and the extension mode is ON after the lapse of the phase end near time (PENT), it may be extended up to the extension limit green (ELG) by the unit green (UG).

Furthermore, when a traffic state in a green time movement is the γ state even prior to the phase end near time (PENT) and the end-possible mode of a different green time movement in the same phase is ON, a corresponding phase is terminated.

Furthermore, when a traffic state is the γ state in a green signal extension, the end-possible mode becomes ON. When the end-possible mode of a different green time movement in the same phase is ON, a corresponding phase is terminated.

A detection area in an alternative movement is performed using the same detection means as that in the detection area in the direction in which a movement has been stopped. In the four-way intersection of FIG. 1, an alternative green time movement for a green time movement in each phase of a separation signal is shown in Table 4. In the four-way intersection of FIG. 1, an alternative green time movement for a green time movement in each phase of a simultaneous signal is shown in Table 5. An alternative green time movement in the three-way intersection of FIG. 5 is shown in Table 6.

TABLE 4

| 1 phase (φ1) | | | 2 phase (φ2) | | | 3 phase (φφ) | | | 4 phase (φ4) | | |
|---|---|---|---|---|---|---|---|---|---|---|---|
| detection area | moving direction | Alternative direction | detection area | moving direction | Alternative direction | detection area | moving direction | Alternative direction | detection area | moving direction | Alternative direction |
| NE | ① going-straight S→N | ⑥ turn left N→E | NE | ⑥ turn left N→E | ① going-straight S→N | ES | ⑦ going-straight W→E | ④ turn left E→S | ES | ④ turn left E→S | ⑦ going-straight W→E |
| SW | ⑤ going-straight N→S | ② turn left S→W | SW | ② turn left S→W | ⑤ going-straight N→S | WN | ③ going-straight E→W | ⑧ turn left W→N | WN | ⑧ turn left W→N | ③ going-straight E→W |

TABLE 5

| 1 phase (φ1) | | | 2 phase (φ2) | | | 3 phase (φ3) | | | 4 phase (φ4) | | |
|---|---|---|---|---|---|---|---|---|---|---|---|
| detection area | moving direction | Alternative direction | detection area | moving direction | Alternative direction | detection area | moving direction | Alternative direction | detection area | moving direction | Alternative direction |
| NE | ① going-straight S→N | ⑥ turn left N→E | WN | ③ going-straight E→W | ⑧ turn left W→N | SW | ⑤ going-straight N→S | ② turn left S→W | ES | ⑦ going-straight W→E | ④ turn left E→S |

TABLE 5-continued

| 1 phase (φ1) | | | 2 phase (φ2) | | | 3 phase (φ3) | | | 4 phase (φ4) | | |
|---|---|---|---|---|---|---|---|---|---|---|---|
| detection area | moving direction | Alternative direction | detection area | moving direction | Alternative direction | detection area | moving direction | Alternative direction | detection area | moving direction | Alternative direction |
| SW | ② turn left S→W | ⑤ going-straight N→S | ES | ④ turn left E→S | ⑦ going-straight W→E | NE | ⑥ turn left N→E | ① going-straight S→N | WN | ⑧ turn left W→N | ③ going-straight E→W |

TABLE 6

| 1 phase (φ1) | | 2 phase (φ2) | | 3 phase (φ3) | |
|---|---|---|---|---|---|
| moving direction | Alternative direction | moving direction | Alternative direction | moving direction | Alternative direction |
| going-straight E→W | None | turn left S→W | going-straight E→W | turn left E→S | going-straight E→W |
| going-straight W→E | turn left E→S | | going-straight W→E | | going-straight W→E |

Furthermore, in the signal control process when the normal state (α state) can be terminated, if a green time movement in a corresponding phase does not correspond to the γ state or the β state and approaches the termination of the phase in the normal state (α state), when the movement extension mode is ON, a green time is extended up to the extension limit green (ELG) by the unit green (UG). When a traffic state is not the normal state (α state) or reaches the extension limit green (ELG), the end-possible mode becomes ON. When the end-possible mode of a different green time movement in the same phase is ON, a corresponding phase is terminated.

The extension of the green time may be applied from the phase end near time (PENT) prior to the termination of a phase for each green time movement. For example, when ON (1) is applied and OFF (0) is not applied, if the extension is designated as in Table 7 in the green time movement of Table 1, the green time can be extended when a vehicle continuously moves with respect to going-straight in each direction. The green time is not extended with respect to turning-left in each direction. Furthermore, the extension mode may become ON or OFF with respect to all of the directions.

Table 7 shows an example in which a green time movement is selected in the extension of a green time.

TABLE 7

| | phase | | | | | | | |
|---|---|---|---|---|---|---|---|---|
| | 1 phase | | 2 phase | | 3 phase | | 4 phase | |
| | detection area | | | | | | | |
| | NE | SW | NE | SW | WN | ES | WN | ES |
| moving direction | S→N (going-straight) | N→S (going-straight) | N→E (turn left) | S→W (turn left) | E→W (going-straight)) | W→E (going-straight) | W→N (turn left) | E→S (turn left) |
| green signal extended application mode | ON (1) | ON (1) | OFF (0) | OFF (0) | ON (1) | ON (1) | OFF (0) | OFF (0) |

Such an example of signal control is described for each traffic state in detail with reference to the drawings.

Figure 10:
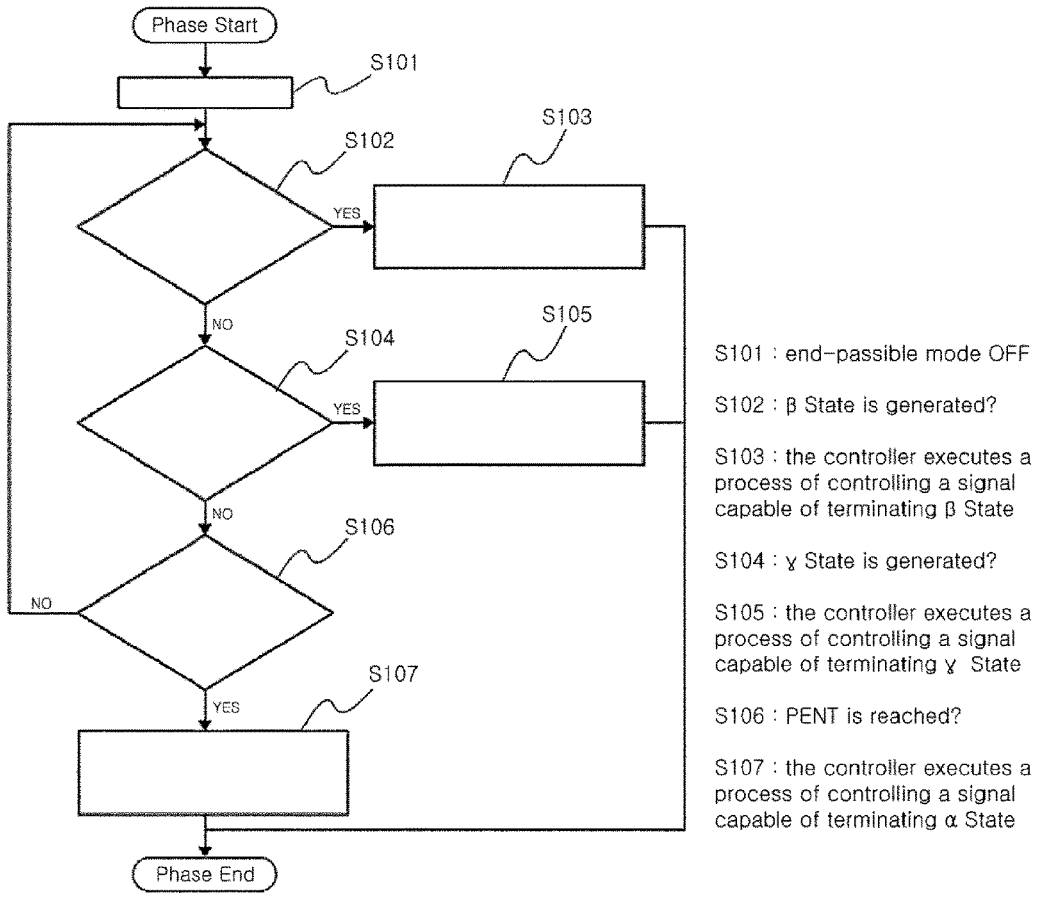
FIG. 10: is an overall signal control process.

FIG. 10 shows an overall signal control processor and shows a process of starting and terminating one phase.

First, when a specific phase starts, the controller turns off the entire end-possible mode of a corresponding phase green time movement (S101)

Furthermore, the controller determines a signal output from a preset detection area in a phase direction and determines a traffic state for each green time movement. When the spillback-possible state (β state) is generated in each green time movement (S102), the controller executes a process of controlling a signal in the spillback-possible state (β state) (S103). When the no-vehicle movement state (γ state) is generated (S104), the controller executes a process of controlling a signal in the no-vehicle movement state (γ state) (S105).

When the phase end near time (PENT) is reached without the generation of the β state or the γ state (S106), the controller executes a process of controlling a signal capable of terminating the normal state (α state) (S106).

When the process is finished, a next phase proceeds.

Furthermore, a case where a traffic state is the spillback-possible state (β state) is described below.

In FIG. 11, when a traffic state is the spillback-possible state (β state) in any one green time movement, the controller executes a process of controlling a signal in the β state. The controller sets a green time movement in which the β state is generated as an A green time movement and sets another green time movement as a B green time movement (S201), and then turns on a red signal after the A green time movement is a yellow signal (S202).

As described above, after the red signal is turned on, the controller determines whether the present time exceeds the residual green time criteria (RGTC) or not (S203). If the present time does not exceed the residual green time criteria (RGTC), when the traffic state becomes the no-vehicle movement state (γ state) in the detection area of the corresponding A green time movement (S204), the controller turns on a green signal again in the A green time movement (S205).

In this state, the controller determines whether the phase end near time (PENT) has been reached (S206). If the phase end near time (PENT) has been reached while the present lighting state is maintained before the phase end near time (PENT), the controller determines whether the green signal extension application mode of the present A green time movement is an "ON" state (S207). If the green signal extension application mode is the "ON" state, the controller determines whether the green time movement maintains the normal state (α state) (S208). If the green time movement is the normal state, the controller extends a green signal by the unit green (UG) (S209). The controller determines whether such extension has reached the extension limit green (ELG) (S210). If the extension has not reached the extension limit green (ELG), the controller repeatedly extends the green signal by the unit green (UG) plural times by repeating steps S208~210. In this process, if the traffic state is determined to be not the normal state (α state) before the extension limit green (ELG) is reached at step S208 or the traffic state is determined to have reached the extension limit green (ELG) at step S210, the controller turns on the end-possible mode of the corresponding green time movement (S211).

Meanwhile, when the state (γ state) in which there is no vehicle in the A green time movement is reached after passing through the residual green time criteria (RGTC) at step S203 (S212), the controller switches to step S206 of the process.

Furthermore, if the traffic state is not the state (γ state) in which there is no vehicle in the A green time movement at step S212, the controller determines whether the traffic state is the phase end near time (PENT) or less (S213). If the traffic state is the phase end near time (PENT) or less, the controller repeats steps S212 and 213. If the traffic state becomes the phase end near time (PENT), the controller determines whether the traffic state is the state (γ state) in which there is no vehicle in the A green time movement (S214). If the traffic state is the state (γ state) in which there is no vehicle in the A green time movement, the controller switches to step S211 of the process. If the traffic state is not the state (γ state) in which there is no vehicle in the A green time movement, the controller extends a red signal by the unit red (UR) (S215) and determines whether the extension limit red (ELR) has been reached (S216). If the extension limit red (ELR) has been reached, the controllers switches to step S211 of the process. If the extension limit red (ELR) has not been reached, the controller repeats steps S214 to S216.

Furthermore, after the controller turns on the end-possible mode of the A green time movement at step S211, it determines whether the end-possible mode of the B green time movement is ON (S217). If the end-possible mode of the B green time movement is ON, the controller terminates the phase (S218).

Furthermore, signal control when the no-vehicle movement state (γ state) is generated is described with reference to FIG. 12.

The controller determines whether the no-vehicle movement state (γ state) has occurred in the present green time movement by determining a traffic state based on a signal output from a preset detection area in response to the green time movement. If the no-vehicle movement state (γ state) has occurred, the controller sets the corresponding green time movement as an A green time movement and sets another green time movement as a B green time movement (S301).

Furthermore, the controller determines whether the crosswalk of the A green time movement is a green lighting state (S302). If the crosswalk is the green lighting state, the controller maintains the corresponding signal lighting state. If the crosswalk is not the green lighting state, the controllers turns on a red signal after a yellow signal with respect to the corresponding A green time movement (S303).

Thereafter, the controller turns on the end-possible mode of the corresponding A green time movement (S304) and determines whether the end-possible mode of the B green time movement is ON (S305). If the end-possible mode of the B green time movement is ON, the controller terminates the phase (S306).

If the end-possible mode of the B green time movement is not ON at step S305, however, the controller determines whether the green signal of the B green time movement is earlier than the residual green time criteria (RGTC) (S307). If the green signal of the B green time movement is earlier than the residual green time criteria (RGTC), the controller returns to step S305 of the process. If the green signal of the B green time movement exceeds the green time criteria (RGTC), the controller turns on an alternative movement of the A green time movement, that is, a green time movement in the γ state, in green (S308), turns off the end-possible mode of the A green time movement (S309), and sets the alternative movement of the A green time movement as the A green time movement (S310).

The controller determines whether the traffic state is the γ state with respect to the A green time movement that has been newly set as the alternative movement of the A green time movement as described above (S311). If the traffic state of the A green time movement is the γ state, the controller turns on the end-possible mode of the corresponding A green time movement (S312) and determines whether the end-possible mode of the B green time movement is ON (S313). If the end-possible mode of the B green time movement is ON, the controller terminates the phase (S306). If the end-possible mode of the B green time movement is not ON, the controller returns to the process of step S311.

Furthermore, if the traffic state of the A green time movement is not the γ state at step S311, the controller determines whether the phase end near time (PENT) has been reached (S314). If the phase end near time (PENT) has not been reached, the controller returns to step S311 of the process. If the phase end near time (PENT) has been reached, the controller determines whether the extension mode of the A green time movement is ON (S315). If the extension mode of the A green time movement is not ON, the controller returns to step S312 of the process. If the extension mode of the A green time movement is ON, the controller determines whether the A green time movement is the α state (S316). If the A green time movement is not the α state, the controller returns to step S312 of the process. If the A green time movement is the α state, the controller extends the green time by the unit green (UG) once or several times (S317) and determines whether the green time has reached the range of a preset extension limit green (ELG) (S318). If the green time has not reached the preset extension limit green (ELG), the controller returns to step S316 of the process. If the green time has reached the preset extension limit green (ELG), the controller returns to step S312 of the process.

Furthermore, signal control when the normal state (α state) may be terminated is described with reference to FIG. 13.

If a green time movement does not correspond to the γ state or the β state in a corresponding phase and approaches the end of the phase in the normal state (α state), when the normal state (α state) is maintained in the phase end near time (PENT), the controller sets the a state green time movement as an A green time movement and sets another green time movement as a B green time movement. In this process, if all of a plurality of green time movements are the α state, the controller sets any one of the plurality of green time movements as the A green time movement and sets the remaining green time movements as the B green time movement (S401).

Thereafter, the controller determines whether the extension mode of the A green time movement is ON (S402). If the extension mode of the A green time movement is not ON, the controller turns on the end-possible mode of the A green time movement (S403). If the extension mode of the A green time movement is ON, the controller extends a green signal by the unit green (UG) (S404) and determines whether the corresponding A green time movement is the α state (S405). If the A green time movement is not the α state, the controller switches to step S403 of the process. If the A green time movement is the α state, the controller determines whether the green time has reached the extension limit green (ELG) (S406). If the green time has not reached the extension limit green (ELG), the controller returns to step S404 of the process and extends the green time up to the extension limit green (ELG).

information of a detected vehicle, and an intersection signal is automatically controlled depending on the traffic state.

In addition, a method of disposing a detection area in a street section outside an intersection and performing signal control in a special case has been invented. This method is described using FIG. 14.

Figure 14:
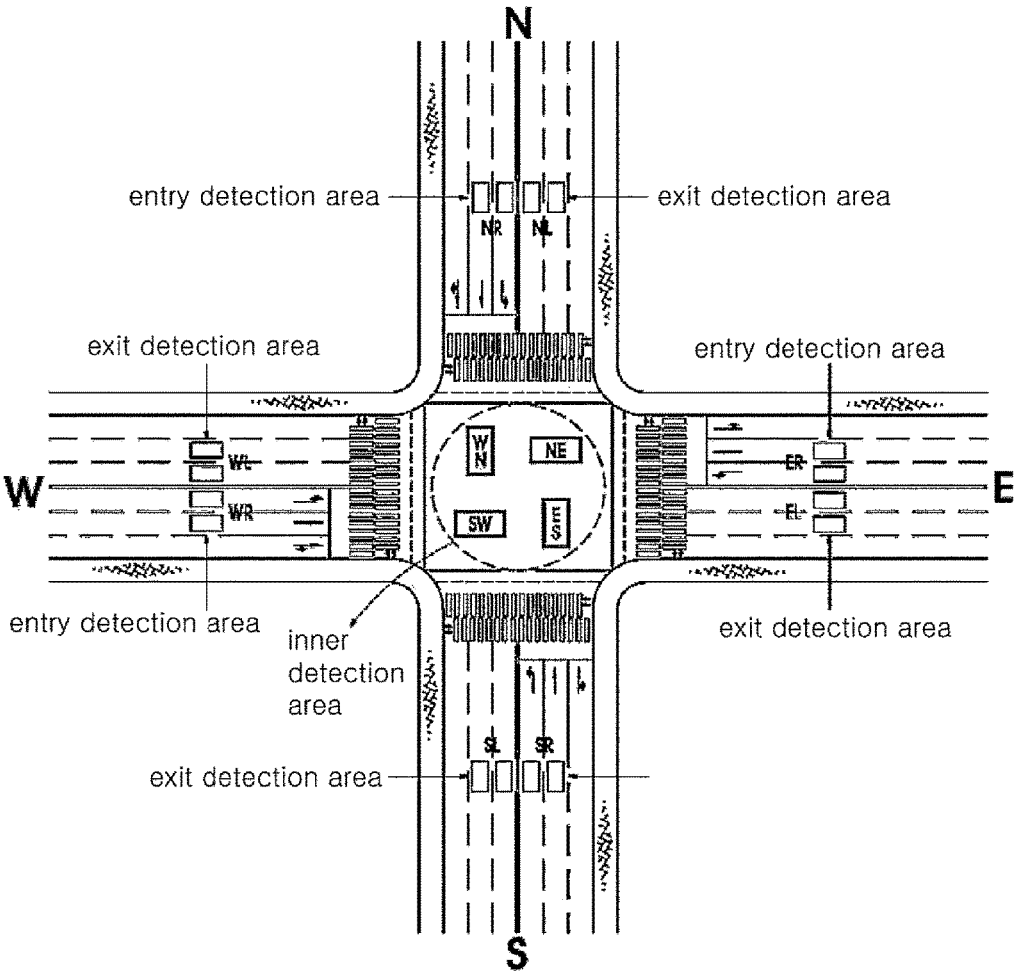
FIG. 14: is an exemplary diagram of the state in which an entry detection area and an entry/exit detection area set outside a signal intersection have been set in the present invention.

FIG. 14 shows that a detection area for each green time movement is set within a four-way signal intersection, entry detection areas and entry/exit detection areas are set outside the four-way signal intersection and in respective street sections, and an operation is subsidiarily performed.

The entry detection areas and the entry/exit detection areas set in the entry areas and exit areas, respectively, are set so that a carriageway in which a right-turn pass is present in the four-way signal intersection is not detected, set so that a going-straight carriageway and a left-turn carriageway are separated, and set so that they are spaced apart at specific interval in an intersection entry area or exit area. Table 8 shows an entry area and entry/exit detection area for each green time movement in a separation signal. Table 9 shows an entry area and entry/exit detection area for each green time movement in a simultaneous signal. In Table 8 and FIG. 9, based on the four-way signal intersection of a green time movement FIG. 1, ① is going-straight from the S direction to the N direction, ② is a left turn from the S direction to the W direction, ③ is going-straight from the E direction to the W direction, ④ is a left turn from the E direction to the S direction, ⑤ is going-straight from the N direction to the S direction, ⑥ is a left turn from the N direction to the E direction, ⑦ is going-straight from the W direction to the E direction, and ⑧ is a left turn from the W direction to the N direction.

TABLE 8

| 1 Phase (φ1) | | | | 2 Phase (φ2) | | | | 3 Phase (φ3) | | | | 4 Phase (φ4) | | | |
|---|---|---|---|---|---|---|---|---|---|---|---|---|---|---|---|
| moving | detection area | | | moving | detection area | | | moving | detection area | | | moving | detection area | | |
| direction | entry | Inner | exit | direction | entry | Inner | exit | direction | entry | Inner | exit | direction | entry | Inner | exit |
| ① | SR | NE | NL | ⑥ | NR | NE | EL | ⑦ | WR | ES | EL | ④ | ER | ES | SL |
| ⑤ | NR | SW | SL | ② | SR | SW | WL | ③ | ER | WN | WL | ⑧ | WR | WN | NL |

TABLE 9

| 1 Phase (φ1) | | | | 2 Phase (φ2) | | | | 3 Phase (φ3) | | | | 4 Phase (φ4) | | | |
|---|---|---|---|---|---|---|---|---|---|---|---|---|---|---|---|
| moving | detection area | | | moving | detection area | | | moving | detection area | | | moving | detection area | | |
| direction | entry | Inner | exit | direction | entry | Inner | exit | direction | entry | Inner | exit | direction | entry | Inner | exit |
| ① | SR | NE | NL | ③ | ER | WN | WL | ⑤ | NR | SW | SL | ⑦ | WR | ES | EL |
| ② | SR | SW | WL | ④ | ER | ES | SL | ⑥ | NR | NE | EL | ⑧ | WR | WN | NL |

Furthermore, when the green time reaches the extension limit green (ELG), the controller turns on the end-possible mode of the A green time movement (S403) and determines whether the end-possible mode of the B green time movement is ON (S407). If the end-possible mode of the B green time movement is ON, the controller terminates the phase (S408).

In the present invention, as described above, a detection area is set within an intersection, the traffic state of a green time movement is determined based on the occupied time Basically, signal control is performed based on detection area information within an intersection, but is performed if entry detection area information is the no-vehicle movement state (γ state) in all of the directions or entry/exit detection area information in a green time movement is the spillback-possible state (β state).

Figure 15:
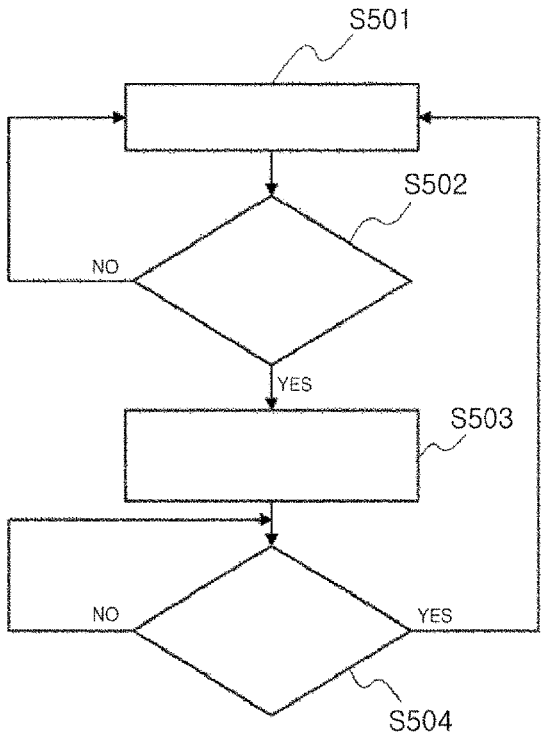
FIG. 15: is a signal control process according to information detected in the entry detection area outside the signal intersection in the present invention.

FIG. 15 is a signal control process according to information about an entry detection area set outside a signal intersection.

First, the controller performs signal control according to a phase sequence recorded on the memory and a phase time (S501). If pass information in the entry detection areas in all of the directions is the no-vehicle movement state (γ state) (S502), the controller turns on a red or yellow signal in all of the directions in a flickering manner (S503). Thereafter, when pass information in the entry detection area in one or more carriageways becomes the normal state (α state) (S504), the controller returns to the original phase operation.

Furthermore, a signal transmitted from the entry detection area is determined. If entry/exit detection area information in a green time movement is the spillback-possible state (β state), signal control is performed as in the case where information in the spillback-possible state (β state) is transmitted in the detection area within the intersection.

If green time information for each phase that has been actually changed and applied in a specific time zone for a specific period in an intersection to which the present invention has been applied is stored and a mean value, etc. is calculated and used as the initial value of a phase length, a more efficient signal operation can be performed.

In the present invention, a detection area is set within a signal intersection, a vehicle that passes through the intersection is determined and detected for each green time movement, a traffic state is determined and analyzed based on the detected information (an occupied time, etc.), and a signal is automatically controlled for each green time movement in a phase according to the traffic state. Accordingly, a spillback phenomenon in an intersection can be prevented, a green time (green lighting time) when there is no vehicle can be minimized, and the green time may be extended, if necessary, to enable smooth traffic easy-going.

The present invention described as above is not limited to the embodiments and the accompanying drawings and may be substituted, modified, and changed in various ways without departing from the technological spirit of the present invention, which are evident to a person having ordinary skill in the art to which the present invention pertains.

The invention claimed is:

1. A method of controlling a traffic signal, the method comprising:

setting a plurality of detection areas in which vehicle pass information within an intersection is detected using image detection or loop detection or both the image detection and the loop detection, wherein the plurality of detection areas are set within the intersection in a circle, oval or polygon shape, a vehicle entering the intersection in response to a signal phase is detected in a different detection area of the plurality of detection areas for each green time movement including going straight and making a left turn, one detection area is set to detect only one green time movement within one phase, and the plurality of detection areas are respectively configured to detect an occupied time (OT) and a gap time (GT) for each vehicle movement;

classifying traffic states according to green time movements into a normal state, a spillback-possible state and a no-vehicle movement state based on vehicle pass information within the signal intersection detected in the respective set detection area; and controlling differentially an intersection signal using a controller for each green time movement depending on the respective classified traffic state, wherein, if a phase is able to be terminated in all of green time movements of the corresponding phase, the corresponding phase is terminated and a next phase is performed, if the traffic state is the spill-back possible state, the traffic light of a corresponding spill-back possible state green time movement is turned on in a red signal after a yellow signal, and in this state, if the corresponding green time movement is the no-vehicle movement state in which there is no vehicle when a residual green time criteria (RGTC) elapse or do not elapse, a green signal is turned on again.

2. The method of claim 1, wherein:

if a green signal is turned on again because the corresponding spill-back possible state green time movement is the no-vehicle movement state in which there is no vehicle after a red signal is turned on, when a movement time reaches a phase end near time (PENT), the green signal is repeatedly extended up to extension limit green (ELG) by unit green (UG), if a movement point of time passes through the residual green time criteria (RGTC) after the red signal is turned on and the spillback-possible state continues in the phase end near time (PENT), the red signal is extended up to extension limit red (ELR) by unit red (UR), and if the corresponding green time movement is not the no-vehicle movement state in which there is no vehicle or is not the normal state after the phase end near time (PENT) elapses, the corresponding phase is terminated.

3. A method of controlling a traffic signal, comprising:

setting a plurality of detection areas in which vehicle pass information within an intersection is detected using image detection or loop detection or both the image detection and the loop detection, wherein the plurality of the detection areas are within the intersection in a circle, oval or polygon shape, and setting one detection area to detect only one green time movement within one phase so that a vehicle entering the intersection in response to a signal phase is detected in a different detection area for each green time movement including going straight and making a left turn, wherein the respective detection area is configured to detect an occupied time (OT) and a gap time (GT) for each vehicle movement;

classifying traffic states according to green time movements into a normal state, a spillback-possible state and a no-vehicle movement state based on vehicle pass information within the signal intersection detected in the respective set detection area, differentially controlling, by a controller, an intersection signal for each green time movement depending on the classified traffic state, and if a phase is able to be terminated in all of green time movements of the corresponding phase, terminating the corresponding phase and performing a next phase; and if the traffic state is the no-vehicle movement state, determining, by the controller, a crosswalk traffic light of a corresponding no-vehicle movement state green time movement, changing the traffic light of the corresponding no-vehicle movement state green time movement to a yellow signal if green is not turned on, then turning on the traffic light in a red signal, and turning on an alternative movement of the no-vehicle movement state green time movement in green if the movement time is earlier than residual green time criteria (RGTC).

4. The method of claim 3, wherein after the alternative movement is turned on in green, a pass state of the alternative movement is determined, and if the pass state of the alternative movement is the normal state even after a phase end near time (PENT) elapses, the green signal is extended up to extension limit green (ELG) by unit green (UG).

5. The method of claim 4, wherein a detection area identical with a detection area in a direction in which a movement has been stopped is used as a detection area of the alternative movement.

6. A method of controlling a traffic signal, comprising:

setting a plurality of detection areas in which vehicle pass information within an intersection is detected using image detection or loop detection or both the image detection and the loop detection, wherein the plurality of the detection areas are within the intersection in a circle, oval or polygon shape, and setting one detection area to detect only one green time movement within one phase so that a vehicle entering the intersection in response to a signal phase is detected in a different detection area for each green time movement including going straight and making a left turn, wherein the respective detection area is configured to detect an occupied time (OT) and a gap time (GT) for each vehicle movement;

classifying traffic states according to green time movements into a normal state, a spillback-possible state and a no-vehicle movement state based on vehicle pass information within the signal intersection detected in the set detection area, differentially controlling, by a controller, an intersection signal for each green time movement depending on the classified traffic state, and if a phase is able to be terminated in all of green time movements of the corresponding phase, terminating the corresponding phase and performing a next phase; and when a green time approaches an end of the phase in the normal state (a state), extending the green time up to extension limit green (ELG) by unit green (UG) in a phase end near time (PENT).

7. The method of claim 6, wherein:

the extension of the green time is applicable from the phase end near time (PENT) before the end of the phase for each green time movement, and a green time extension mode is set for each phase in advance.

* * * * *